US005429900A

United States Patent [19]

Asanae et al.

[11] Patent Number: 5,429,900

[45] Date of Patent: Jul. 4, 1995

[54] MAGNETIC DEVELOPER

[75] Inventors: Masumi Asanae, Kumagaya; Ryuji Goto; Akihiko Funakawa, both of Fukaya, all of Japan

[73] Assignee: Hitachi Metals, Ltd., Tokyo, Japan

[21] Appl. No.: 950,900

[22] Filed: Sep. 25, 1992

[30] Foreign Application Priority Data

Oct. 4, 1991 [JP] Japan ..... 3-257386
Oct. 4, 1991 [JP] Japan ..... 3-257387
Oct. 14, 1991 [JP] Japan ..... 3-264297

[51] Int. Cl.[6] ..... G03G 9/083
[52] U.S. Cl. ..... 430/106.6; 430/110
[58] Field of Search ..... 430/106.6, 110

[56] References Cited

U.S. PATENT DOCUMENTS 4,433,042 2/1984 Kawanishi et al. ..... 430/126
4,640,880 2/1987 Kawanishi et al. ..... 430/106.6
5,053,305 10/1991 Aoki et al. ..... 430/111

FOREIGN PATENT DOCUMENTS 57-45556 3/1982 Japan ..... 430/106.6
57-70538 5/1982 Japan ..... 430/110
4-116662 4/1992 Japan ..... 430/106.6

OTHER PUBLICATIONS

USPTO English-Translation of Japanese Kokai Patent Application No. 57-70538 (May 1, 1982).
USTPO English-Translation of Japanese Kokai Patent Application No. 57-45556 (Mar. 15, 1982).
USPTO English-Translation of Japanese Kokai Patent Application No. 4-116662 (Apr. 17, 1992).

*Primary Examiner*—Janis L. Dote
*Attorney, Agent, or Firm*—Finnegan, Henderson, Farabow, Garrett & Dunner

[57] ABSTRACT

A magnetic developer comprising magnetic toner particles each comprising a binder resin, magnetic powder and a first charge-controlling agent, and magnetic carrier particles in mixture, and further containing 0.05 to 1 part by weight of a second charge-controlling agent being provided on the outer surfaces of the magnetic toner particles on the basis of 100 parts by weight of the magnetic toner particles has better triboelectric characteristics and a highly stabilized image density in the continuous development.

2 Claims, 1 Drawing Sheet

MAGNETIC DEVELOPER

BACKGROUND OF THE INVENTION

The present invention relates to a magnetic developer comprising magnetic toner particles and magnetic carrier particles in mixture, which is used in the development of electrostatic images formed on the surface of an image carrier by magnetic brushing, and more particularly to a magnetic developer having better triboelectric characteristics and a highly stabilized image density in the continuous development.

In the development of electrostatic images formed on the surface of an image carrier, magnetic brushing is generally used. In most cases, a two-components-based developer comprising magnetic carrier particles and non-magnetic toner particles in mixture is used as a developer for the magnetic brushing development. On the other hand, a single component-based developer comprising a resin and magnetic powder is also used as the developer. The development with the former two-components-based developer can produce images with a good image concentration and a good resolution, but has a poor half-tone reproducibility.

The development with the latter single component-based developer has such problems as occurrence of aggregation of toner particles by electrocharging due to an increase in the charged quantity of toner particles and poor development due to shortage of toner particles on the sleeve. To solve these problems, for example, U.S. Pat. No. 4,640,880 and U.S. Pat. No. 5,053,305 propose magnetic developers each based on a mixture of magnetic carrier particles and magnetic toner particles, stating that the proposed magnetic developers have advantages of both of the conventional two-components-based developer and single component-based developer.

Development of electrostatic images with the above-mentioned developer based on a mixture of magnetic carrier particles and magnetic toner particles has advantages of the developments with the two-component-based developer and also with the single component developer, but when the magnetic toner particles have a lower coercive force or when the magnetic toner particles contain less magnetic powder, it has a problem of no sharper developed images. That is, due to poor transportability of the developer by a non-magnetic sleeve positioned against the surface of an image carrier and provided with a magnetic field-generating member such as a permanent magnet, etc. inside, makeup for the magnetic toner particles consumed by sliding friction on the surface of the image carrier by a magnetic brush will be short, resulting in a higher concentration of magnetic carrier particles.

In solving the problem, it is not desirable to simply increase the number of revolutions per minute of the sleeve or the magnetic field-generating member as a means of supplying the magnetic developer, because this considerably deteriorates office atmospheres due to generation of noises, etc., and it is not acceptable to increase the outer diameter of the sleeve or the magnetic field-generating member, because this is against the recent requirements for smaller size, thinner type and smaller weight of the developing apparatuses.

Furthermore, the magnetic toner particles that constitute a magnetic developer contain a charge-controlling agent such as a nigrosine dye or a metal-containing azo dye to give a sufficient changeability, that is, to control the charging. By addition of the charge-controlling agent, the changeability of the magnetic developer can be increased and the image density can be improved. That is, the magnetic toner particles are held on the surfaces of magnetic carrier particles by magnetic attractive forces on the way to the development zone by the magnetic transportation means, and thus the deposition force of magnetic toner particles onto the photosensitive member by an electrostatic force in the development zone can be increased by improving the chargeability of magnetic toner particles, thereby improving the image density.

In the above-mentioned, conventional two-components-based developer, holding of the magnetic carrier particles and the non-magnetic toner particles is attained only by the electrostatic force, and thus the improvement of the chargeability of non-magnetic toner particles causes to increase the deposition force of the magnetic carrier particles and the non-magnetic toner particles in the development zone, resulting in a decrease in the image density.

To improve the chargeability of magnetic toner particles, it is effective to contain the charge-controlling agent, as mentioned above, but the charge-controlling agent has a low compatibility with a binder resin that constitutes the magnetic toner particles, and a poor dispersibility. That is, there is a limit to the content of the charge-controlling agent, and it is difficult to obtain the necessary chargeability. Thus, the chargeability is low just after the start of the developing apparatus, and it takes a long time until the desired chargeability is obtained, that is, the rise time is prolonged and there is also such a problem as a lowered image density in the continuous development.

SUMMARY OF THE INVENTION

An object of the present invention is to provide a magnetic developer with a high chargeability and stabilized image density even in the continuous development, where the problems of the above-mentioned conventional technique have been solved.

According to the first aspect of the present invention, there is provided a magnetic developer, which comprises magnetic toner particles each comprising a binder resin, magnetic powder and a first charge-controlling agent, and magnetic carrier particles in mixture, the content of the magnetic powder being 40 to 75% by weight and the content of the first charge-controlling agent being 0.5 to 5% by weight, and 0.05 to 1 part by weight of a second charge-controlling agent being provided on the outer surfaces of the magnetic toner particles on the basis of 100 parts by weight of the magnetic toner particles.

According to the second aspect of the present invention, there is provided a magnetic developer, which comprises magnetic toner particles each comprising a binder resin, magnetic powder and a first charge-controlling agent, and magnetic carrier particles in mixture, the content of the magnetic powder being 50 to 75% by weight and the content of the first charge-controlling agent being 0.5 to 5% by weight, and 0.05 to 1 part by weight of a second charge-controlling agent having a lower volume resistivity than that of the first charge-controlling agent being provided on the outer surfaces of the magnetic toner particles on the basis of 100 parts by weight of the magnetic toner particles.

According to the third aspect of the present invention, there is provided a magnetic developer, which comprises magnetic toner particles each comprising a binder resin, magnetic power and a first charge-controlling agent, and magnetic carrier particles in mixture, the content of the magnetic powder being 10 to 60% by weight and the content of the first charge-controlling agent being 0.5 to 5% by weight, and 0.05 to 1 part by weight of a second charge-controlling agent having a higher volume resistivity than that of the first charge-controlling agent being provided on the outer surfaces of the magnetic toner particles on the basis of 100 parts by weight of the magnetic toner particles.

DETAILED DESCRIPTION OF THE INVENTION

Figure 1:
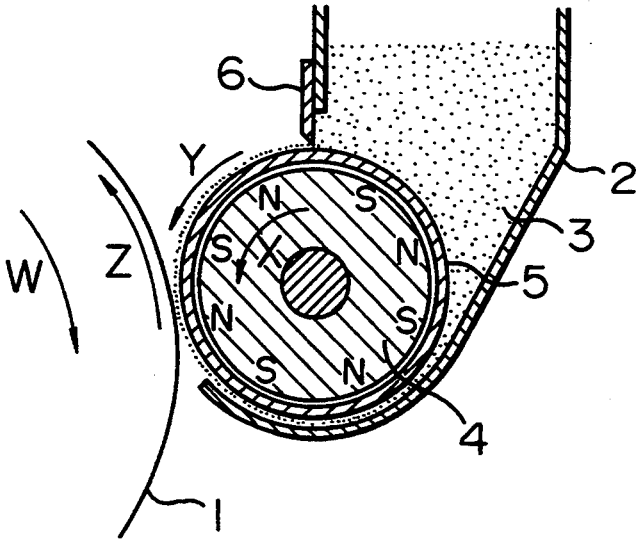
FIG. 1 is a vertical cross-sectional view in the essential part of a developing apparatus according to one embodiment of the present invention.

In the first aspect of the present invention, the first charge-controlling agent to be contained in the toner particles and the second charge-controlling agent to be provided on the outer surfaces of the toner particles are preferably of the same kind or in the same specification.

In the second and third aspects of the present invention, the first charge-controlling agent to be contained in the toner particles and the second charge-controlling agent to be provided on the outer surfaces of the toner particles preferably have a difference in their volume resistivity of more than $10^2$ Ω-cm, more preferably more than $10^3$ Ω-cm.

In the present invention, the volume resistivity is determined by weighing out about several 10 mg of a sample, filling the sample into a polyacetal insulated cylinder, 3.05 mm in inner diameter (cross-sectional area: 0.073 $mm^2$) of a modified dial gage, and measuring a resistance of the sample under a load of 0.1 kg weight in an electric field of D.C. 4,000 V/cm (by Yokogawa-Hewlett-Packard insulation resistance tester, type 4329 A), followed by calculation from the measurements.

In the first aspect of the present invention, commercially available charge-controlling agents are used for the first charge-controlling agent to be contained in the toner particles and the second charge-controlling agent to be provided on the outer surfaces of the toner particles. Specially, one or a combination of at least two of, for example, Bontron E81, a chromium-containing compound, (made by Orient Chemical Industries, Ltd., Japan; volume resistivity: $1\times10^{15}$ Ω-cm), Bontron E84 a zinc-containing salicylate, (made by Orient Chemical Industries, Ltd., Japan; volume resistivity: $8\times10^{14}$ Ω-cm), (made by Orient Chemical a chromium-containing azo dye, and Kayacharge T2 a chromium-containing axo dye, (chromium complex-type azo compound, (made by Nippon Kayaku Co., Ltd., volume resistivity: $4\times10^{12}$ Ω-cm), or a combination of Kayacharge T2 as mentioned above and Bontron S34 a metal-containing azo dye, (made by Orient Chemical Industries, Ltd., Japan; volume resistivity: $5\times10^{12}$ Ω-cm) can be used.

In the second aspect of the invention, commercially available charge-controlling agents are used for the first charge-controlling agent to be contained in the toner particles and also for the second charge-controlling agent to be provided on the outer surfaces of the toner particles. Specially a combination of, for example, and Bontron E81, as mentioned above, Bontron E84, as mentioned above, for the first charge-controlling agent and Bontron S34, as mentioned above, for the second charge-controlling agent can be used, or a combination of Bontron S34, as mentioned above, and Kayacharge T2, as mentioned above, for the first charge-controlling agent in addition to the above-mentioned combination for the first charge-controlling agent, and Kayacharge T5 a chromium complex-type azo compound, (made by Nippon Kayaku Co., Ltd.; volume resistivity: $7\times10^8$ Ω-cm) for the second charge-controlling agent can be used.

In the third aspect of the present invention, commercially available charge-controlling agents can be used in the following combinations. When the first charge-controlling agent to be contained in the toner particles is Kayacharge T5, as mentioned above, one of Bontron E81, as mentioned above, Bontron E84, as mentioned above, Bontron S34, as mentioned above, and Kayacharge T2, as mentioned above, can be used for the second charge controlling agent to be provided on the outer surfaces of the toner particles. When the first charge-controlling agent is Bontron S34, as mentioned above, or Kayacharge T2, as mentioned above, Bontron E84, as mentioned above, can be used for the second charge-controlling agent.

The charge-controlling agent of lower volume resistivity can effectively reduce the resistance of toner particles when toner chains are formed and also can effectively increase the developability by charge injection. The charge-controlling agent of higher volume resistivity can effectively prevent leakage in the transfer of toner particles on the photosensitive member, thereby increasing the transfer efficiency.

In the present invention, no improvement of the chargeability is expected below 0.05 parts by weight of the second charge-controlling agent to be provided on the outer surfaces of the magnetic toner particles, and no sharper images can be obtained, while above 1 part by weight, fouling or other inconveniences appear.

The second charge-controlling agent can be provided on the outer surfaces of the magnetic toner particles not only by mechanical mixing, but also by heating the second charge-controlling agent and depositing it onto the outer surfaces of the magnetic toner particles or by dissolving the second charge-controlling agent in a solvent in advance, and spraying the resulting solution onto the outer surfaces of the magnetic toner particles. The second charge-controlling agent can be provided onto the outer surfaces of the magnetic toner particles together with fine oxide particles of silica, alumina, titania, etc.

The magnetic toner particles for use in the present invention can be prepared from resin for fixation and magnetic powder, if necessary, together with various additives such as a first charge-controlling agent, a resistance-adjusting agent, a flowability-improving agent, etc. The resin for fixation can be appropriately selected, depending on a fixation system (see, for example, U.S. Pat. No. 4,433,042). In case of a heat roll fixation system, styrene-acrylic copolymer, styrene-butadiene copolymer, polyester resin, epoxy resin or their mixtures can be used.

The magnetic powder for use in the present invention include alloys and compounds containing ferromagnetic elements such as iron, cobalt, nickel, etc. including ferrite and magnetite. It is desirable from the viewpoint of incorporation of the magnetic powder into magnetic toner particles that the magnetic powder has an average particle size of about 0.1 to about 3 μm. The coercive force of the magnetic toner particles substantially depends on the coercive force of the magnetic powder, and thus the coercive force of the magnetic toner particles can be adjusted by changing magnetic powder species. In the first aspect of the present invention, scattering of the magnetic toner particles is increased below 40% by weight of the magnetic powder, whereas above 75% by weight the fixability is lowered. Thus, a preferable range is 40 75% by weight, more preferably 50 to 70% by weight.

In the second aspect of the present invention, scattering of the magnetic tower particles is increased below 50% by weight of the magnetic powder, whereas the fixability is lowered above 75% by weight. Thus, a preferable range is 50 to 75% by weight.

In the third aspect of the present invention scattering of the magnetic toner particles is increased below 10% by weight when the transportability of a developer is low, whereas the fixability is lowered above 60% by weight. Thus, a preferable range is 10 to 60% by weight, more preferably 15 to 50% by weight.

Among the additives for use in the present invention, usually applicable charge controlling agent includes a nigrosine dye having a positive charge characteristic and metal (e.g. Cr)-containing azo dyes having a negative charge characteristic; usually applicable resistance-adjusting agent is carbon black; and usually applicable flowability-improving agent includes fine oxide particles, typical of which is hydrophobic silica. Addition of too much additives deteriorates the fixability of magnetic toner particles, and thus a total amount of these additives to be contained is not more than 10% by weight.

Average particle size of magnetic toner particles in various compositions can be adjusted to 50 to 30 μm, preferably 6 to 15 μm, as in the case of the conventional single component-based developer.

Well known magnetic carrier particles can be used in the present invention. Carrier particles containing iron oxide such as magnetite or ferrite (Ni-Zn system, Mg-Zn system, Cu-Zn system, Ba-Ni-Zn system, etc.) are preferable from the viewpoint of image quality.

The magnetic carrier particles preferably can have an average particle size of 20 to 150 μm, preferably 50 to 100 μm as in the case of the conventional two-components-based developer.

The present developer can be prepared by mixing magnetic carrier particles and magnetic toner particles, where a mixing ratio of magnetic toner particles (toner concentration) is preferably 10 to 95% by weight. When the toner concentration exceeds 95% by weight, the magnetic toner particles are readily scattered and the amount of spent toner particles is increased, whereas when the toner concentration is below 10% by weight, a sharp image is less obtainable and the carrier particles attach to the surface of the image carrier. The toner concentration can be appropriately determined by developing conditions, etc., and is preferably in a range of 20 to 80% by weight, more preferably 30 to 70% by weight.

The present developer according to the first aspect of the present invention can be applied to various developing systems, particularly effectively to a dual revolution system where both of a permanent magnet member and a sleeve are rotated. Particularly as will be explained later, referring to FIG. 1, the first aspect of the present invention is effective for such a case that the permanent magnet member 4 and the sleeve 5 are rotated in the same direction (X direction) and the developer is transported in the same direction (Y direction), but in a direction opposite to the photosensitive member 1 (Z direction) in the developing zone, where a ratio of the number of revolution per minute of the sleeve 5 to that of the permanent magnet member 4 is set preferably to 1/20 or more, more preferably to 1/10 to 1/20. The first aspect of the present invention can be also effectively applied to such a case that the permanent magnet member 4 and the sleeve 5 are rotated in directions opposite to each other and the developer 3 is transported in the same direction as that of the sleeve 5.

The present developer according to the second aspect of the present invention can be applied to various developing systems, and particularly effectively to a dual revolution system where both of a permanent magnet member and a sleeve are rotated. Particularly as will be explained later, referring to FIG. 1, the second aspect of the present invention is effective for such a case that the sleeve 5 is rotated in X direction, the permanent magnet member 4 in Y direction, and the developer 3 in X direction, but in the same direction as that of the photosensitive member 1 (W direction) in the developing zone, where a ratio of the number of revolution per minute of the sleeve 5 to that of the permanent magnet member 4 is set preferably to 1/10 to 1/20. The second aspect of the present invention can be also effectively applied to such a case that the permanent magnet member 4 and the sleeve 5 are rotated in the same directions and the developer 3 is transported in the direction opposite to that of the photosensitive member 1 in the developing zone.

The present developer according to the third aspect of the present invention can be applied to various developing systems, and particularly effectively to a sleeve revolution system, where only the sleeve is rotated while the permanent magnet member is fixed. Developing conditions for the sleeve revolution system are to set the surface transfer speed of the sleeve to 1.5 to 4.5 times the surface transfer speed of the image carrier and transfer the sleeve in the same direction as that of the image carrier in the developing zone (see U.S. patent application Ser. No. 662,190).

With the above-mentioned structures and by the presence of the second charge controlling agent even on the outer surfaces of the magnetic toner particles, the chargeability can be increased, and particularly the triboelectric charging can be promoted just after the start of a developing apparatus, shortening the so called rise time.

PREFERRED EMBODIMENTS OF THE INVENTION

EXAMPLE 1

| | |
|---|---|
| Styrene-n-butyl methacrylate copolymer ($mn = 1.6 \times 10^4$; $Mw = 21 \times 10^4$) | 42 wt. % |
| Magnetic powder (EPT500, trademark of a product made by Toda Kogyo Corporation, Japan) | 50 wt. % |
| Polypropylene (Vischol 550P, trademark of a product made by Sanyo Kasei K.K., Japan) | 5 wt. % |
| Charge-controlling agent (Bontron E81, trademark of a product made by Orient Chemical Industries, Ltd., Japan: volume resistivity: $1 \times 10^{15}$ Ω-cm | 3 wt. % |

-continued

| |
|---|
| at 4000 V/cm) |

These raw materials in the above-mentioned composition were dry mixed, then kneeded with heating at 200° C., cooled, solidified and then pulverized. Then, 0.5 parts by weight of hydrophobic silica (Aerosil R972, trademark of a product made by Nippon Aerosil K.K., Japan) were added thereto on the basis of 100 parts by weight of the mixture, followed by heat treatment at 120° C. and classification to obtain magnetic toner particles having an average particle size of 11 μm. Then, 0.05 to 2 parts by weight of the same charge-controlling agent as above, i.e. Bontron E81, a trademark of a product made by Orient Chemical Industries, Ltd., Japan, were provided as a second charge controlling agent on the outer surfaces of the magnetic toner particles on the basis of 100 parts by weight of the magnetic toner particles. Then, 40 parts by weight of ferrite carrier particles KBN-220 (a product made by Hitachi Metals K.K., Japan, particle sizes: 74–149 μm) and 100 parts by weight of the resulting magnetic toner particles were mixed together to prepare a magnetic developer.

FIG. 1 shows a vertical cross-sectional view of an essential part of a developing apparatus used in the present invention, where numeral 1 is a photosensitive member in a cylindrical form, which is rotatable in the arrowed Z direction; 2 is a developer container, which stores a developer 3, as prepared in the above-mentioned manner; 4 is a permanent magnet member, which is, for example, in a cylindrical form with eight magnetic poles extended in the axial direction at the outer periphery and is disposed against the photosensitive member 1 and rotatable in the arrowed X direction; 5 is a sleeve in a hollow cylindrical form, made of a non-magnetic material, for example, stainless steel and is coaxially provided with the permanent magnet member 4 and rotatable in the arrowed X direction; and 6 is a docter blade member, whose edge is positioned close to the surface of the sleeve 5 at the developer container 2.

In the above-mentioned structure, the photosensitive member 1, the permanent magnet member 4 and the sleeve 5 were rotated counterclockwise, respectively, the developer 3 was attracted onto the surface of the sleeve 5 by the magnetic attractive force exerted by the permanent magnet member 4 and transported in the same direction as the rotating direction of the sleeve 5 to develop electrostatically charged images formed on the surface of the photosensitive member 1. Development was carried out in the following conditions in a developing apparatus of the above-mentioned structure with the magnetic developers prepared in the above-mentioned manner.

That is, an organic photoconductive drum (OPC) was used as the photosensitive member 1 under such conditions as a surface potential of −650 V, a peripheral speed of 60 mm/sec. and a D.C. bias voltage of −550 V applied to the sleeve. The permanent magnetic member 4 and the sleeve 5 were rotated at 1,200 rpm and 160 rpm, respectively. The sleeve 5 had an outer diameter of 20 mm, and the permanent magnet member 4 had 8 magnetic poles which were symmetrically magnetized. A surface magnetic flux density on the sleeve 5 was set to 650 Gaus. A development gap between the photosensitive member 1 and the sleeve 5 was set to 0.35 mm and a doctor knife gap between the doctor blade member 6 and the sleeve 5 was set to 0.30 mm.

Results of developed image evaluation are shown in Table 1.

TABLE 1

| Sample No. | Amount of second charge-controlling agent (parts by weight) | Image density | Resolution (lines/mm) | Fogging (%) |
|---|---|---|---|---|
| 1 | 0 | 1.18 | 6 | 3.2 |
| 2 | 0.05 | 1.31 | 10 | 1.5 |
| 3 | 0.1 | 1.35 | 10 | 0.9 |
| 4 | 0.5 | 1.40 | 10 | 0.8 |
| 5 | 1.0 | 1.41 | 8 | 0.9 |
| 6 | 8.0 | 1.45 | 6 | 5.2 |

As is obvious from Table 1, Sample No. 1 containing no second charge-controlling agent has lower image density and resolution with more fogging. With increasing amount of the second charge-controlling agent, both image density and resolution are improved with less fogging (Sample Nos. 2 to 5). On the other hand, Sample No. 6 provided with 2.0 parts by weight of the second charge-controlling agent has a higher image density, but a lower resolution with much more fogging.

EXAMPLE 2

| | |
|---|---|
| Styrene-n-butyl methacrylate copolymer ($Mn = 1.6 \times 10^4$; $Mw = 21 \times 10^4$) | 42 wt. % |
| Magnetic powder (EPT500, trademark of a product made by Toda Kogyo Corporation, Japan) | 50 wt. % |
| Polypropylene (Vischol 550P, trademark of a product made by Sanyo Kasei K.K., Japan) | 5 wt. % |
| Charge-controlling agent (Bontron E81, trademark of a product made by Orient Chemical Industires, Ltd., Japan: volume resistivity: $1 \times 10^{15}$ Ω-cm at 4000 V/cm) | 3 wt. % |

These raw materials in the above-mentioned composition were dry mixed, then kneeded with heating at 200° C., cooled, solidified and then pulverized. Then, 0.5 parts by weight of hydrophobic silica (Aerosil R972 trademark of a product made by Nippon Aerosil K.K. Japan) were added thereto on the basis of 100 parts by weight of the mixture, followed by heat treatment at 120° C. and classification to obtain magnetic toner particles having an average particle size of 11 μm. Then, 0.05 to 2 parts by weight of another charge-controlling agent, Bontron S34, (a trademark of a product made by Orient Chemical Industries, Ltd., Japan; volume resistivity: $5 \times 10^{12}$ Ω-cm) were provided as a second charge controlling agent on the outer surfaces of the magnetic toner particles on the basis of 100 parts by weight of the magnetic lower particles. Then, 40 parts by weight of ferrite carrier particles (KBN-220, a product made by Hitachi Metals K.K., Japan; particle sizes: 74–149 μm) and 100 parts by weight of the resulting magnetic toner particles were mixed together to prepare a magnetic developer.

In the structure of FIG. 1, the photosensitive member 1 and the permanent magnet member 4 were rotated clockwise and the sleeve 5 was rotated counterclockwise, the developer 3 was attracted onto the surface of the sleeve 5 by the magnetic attractive force exerted by the permanent magnet member 4 and transported to develop electrostatically charged images formed on the surface of the photosensitive member 1. Development was carried out in the following conditions in a developing apparatus of the above-mentioned structure with the magnetic developer prepared in the above-mentioned manner.

That is, the OPC was used as the photosensitive member 1 under such conditions as a surface potential of −700 V, a peripheral speed of 150 mm/sec. and a D.C. bias voltage of −580 V applied to the sleeve. The permanent magnetic member 4 and the sleeve 5 were rotated at 1,000 rpm and 120 rpm, respectively. The sleeve 5 had an outer diameter of 20 mm, and the permanent magnet member 4 had 8 magnetic pole which were symmetrically magnetized. A surface magnetic flux density on the sleeve 5 was set to 650 Gaus. A development gap between the photosensitive member 1 and the sleeve 5 was set to 0.35 mm and a doctor gap between the doctor blade member 6 and the sleeve 5 was set to 0.30 mm.

Results of developed image evaluation are shown Table 2.

TABLE 2

| Sample No. | Amount of second charge-controlling agent (parts by weight) | Image density | Resolution (lines/mm) | Fogging (%) |
|---|---|---|---|---|
| 1 | 0 | 1.18 | 6 | 2.6 |
| 2 | 0.05 | 1.33 | 8 | 1.4 |
| 3 | 0.1 | 1.34 | 10 | 1.2 |
| 4 | 0.5 | 1.41 | 10 | 1.0 |
| 5 | 1.0 | 1.43 | 10 | 1.0 |
| 6 | 1.0 | 1.51 | 6 | 4.8 |

As is obvious from Table 2, Sample No. 1 containing no second charge-controlling agent has lower image density and resolution with more fogging. With increasing amount of the second charge-controlling agent, both image density and resolution are improved with less fogging (Sample Nos. 2 to 5). On the other hand, Sample No. 6 provided with 2.0 parts by weight of the second charge-controlling agent has a higher image density, but a lower resolution with much more fogging.

EXAMPLE 3

| | |
|---|---|
| Styrene-n-butyl methacrylate copolymer ($Mn = 1.6 \times 10^4$; $Mw = 21 \times 10^4$) | 47 wt. % |
| Magnetic powder (EPT500, trademark of a product made by Toda Kogyo Corporation, Japan) | 45 wt. % |
| Polypropylene (Vischol 550P, trademark of a product made by Sanyo Kasei K.K., Japan) | 5 wt. % |
| Charge-controlling agent (Kayacharge T5, trademark of a product made by Nippon Kayaku Co., Ltd., Japan: volume resistivity: $7 \times 10^8$ Ω-cm at 4000 V/cm) | 3 wt. % |

These raw materials in the above-mentioned composition were dry mixed, then kneaded with heating at 200° C., cooled, solidified and then pulverized. Then, 0.5 parts by weight of hydrophobic silica (Aerosil R972, trademark of a product made by Nippon Aerosil K.K., Japan) were added thereto on the basis of 100 parts by weight of the mixture, followed by heat treatment at 120° C. and classification to obtain magnetic toner particles having an average particle size of 11 μm. Then, 0.05 to 2 parts by weight of another charge-controlling agent (Bontron E81, trademark of a product made by Orient Chemical Industries, Ltd., Japan) were provided as a second charge controlling agent on the outer surfaces of the magnetic toner particles on the basis of 100 parts by weight of the magnetic toner particles. Then, 40 parts by weight of ferrite carrier particles (KBN-100, a product made by Hitachi Metals K.K., Japan; particle sizes: 37–74 μm) and 100 parts by weight of the resulting magnetic toner particles were mixed together to prepare a magnetic developer.

In the structure of FIG. 1, the photosensitive member 1 was rotated clockwise and the sleeve 5 was rotated counterclockwise, the developer 3 was attracted onto the surface of the sleeve 5 by the magnetic attractive force exerted by the permanent magnet member 4 and transported to develop electrostatically charged images held on the surface of the photosensitive member 1. Development was carried out in the following conditions in a developing apparatus of the above-mentioned structure with the magnetic developers prepared in the above-mentioned manner.

That is, the OPC was used as the photosensitive member 1 under such conditions as a surface potential of −650 V, a peripheral speed of 60 mm/sec. and a D.C. bias voltage of −550 V applied to the sleeve. The sleeve, 5,120 mm in outer diameter, was rotated at 160 rpm. The permanent magnet member 4 had 4 magnetic poles which were symmetrically magnetized. A surface magnetic flux density on the sleeve 5 was set to 650 Gaus. A development gap between the photosensitive member 1 and the sleeve 5 was set to 0.35 mm and a doctor gap between the doctor blade member 6 and the sleeve 5 was set to 0.30 mm.

Results of developed image evaluation are shown in Table 3.

TABLE 3

| Sample No. | Amount of second charge-controlling agent (parts by weight) | Image density | Resolution (lines/mm) | Fogging (%) |
|---|---|---|---|---|
| 1 | 0 | 1.22 | 6 | 0.4 |
| 2 | 0.05 | 1.35 | 8 | 0.5 |
| 3 | 0.1 | 1.40 | 10 | 0.5 |
| 4 | 0.5 | 1.42 | 10 | 0.5 |
| 5 | 1.0 | 1.43 | 10 | 0.5 |
| 6 | 2.0 | 1.51 | 10 | 3.8 |

As is obvious from Table 3, Sample No. 1 containing no second charge-controlling agent has lower image density and resolution. With increasing amount of the second charge-controlling agent, both image density and resolution are improved. On the other hand, Sample No. 6 provided with 2.0 parts by weight of the second charge-controlling agent has more fogging. In Samples Nos. 2 to 5 of the present invention images of high quality with less fogging are obtained.

In the first aspect of the present invention, the triboelectric charging characteristics of the magnetic developer can be considerably increased in a developing system where the permanent magnet member and the sleeve rotate in the same direction and the surface of the photosensitive member and the developer are transferred in the opposite direction in the developing zone owing to the structure and functions as described in Example 1, and thus the necessary rise time after the start of a developing apparatus can be shortened. Furthermore, the image density is not lowered in the continuous development, and thus the stable state can be effectively maintained.

In the second aspect of the present invention the triboelectric charging characteristics of the magnetic developer can be considerably increased in a developing system where the permanent magnet member and the sleeve rotate in directions opposite to each other, and the surface of the photosensitive member and the developer are transferred in the same direction in the developing zone owing to the structure and functions as described in Example 2, and thus the necessary rise time after the start of a developing apparatus can be shortened. Furthermore, the image density is not lowered in the continuous development, and thus the stable state can be effectively maintained.

In the third aspect of the present invention the triboelectric charging characteristics of the magnetic developer can be considerably increased in a developing system where the permanent magnet member is fixed, and the surface of the photosensitive member and the surface of the sleeve are transferred in the same direction owing to the structure and functions as described in Example 3, and thus the necessary rise time after the start of a developing apparatus can be shortened. Furthermore, the image density is not lowered in the continuous development, and thus the stable state can be effectively maintained.

What is claimed is:

1. A magnetic developer, which comprises magnetic toner particles each comprising a binder resin, magnetic powder and a first charge-controlling agent, and magnetic carrier particles in mixture, the content of the magnetic powder being 50 to 75% by weight and the content of the first charge-controlling agent being 0.5 to 5% by weight, and 0.05 to 1 part by weight of a second charge-controlling agent having a lower volume resistivity than that of the first charge-controlling agent and being provided on the outer surfaces of the magnetic toner particles on the basis of 100 parts by weight of the magnetic toner particles.

2. A magnetic developer, which comprises magnetic toner particles each comprising a binder resin, magnetic powder and a first charge-controlling agent, and magnetic carrier particles in mixture, the content of the magnetic powder being 10 to 60% by weight and the content of the first charge-controlling agent being 0.5 to 5% by weight, and 0.05 to 1 part by weight of a second charge-controlling agent having a higher volume resistivity than that of the first charge-controlling agent and being provided on the outer surfaces of the magnetic toner particles on the basis of 100 parts by weight of the magnetic toner particles.

* * * * *